US007547386B1

(12) United States Patent
Thakkar et al.

(10) Patent No.: US 7,547,386 B1
(45) **Date of Patent: *Jun. 16, 2009**

(54) INTEGRATED PROCESS BY HYDROPROCESSING MULTIPLE FEEDS

(75) Inventors: Vasant P. Thakkar, Elk Grove Village, IL (US); Richard K. Hoehn, Mount Prospect, IL (US)

(73) Assignee: UOP LLC, Des Plaines, IL (US)

( * ) Notice: Subject to any disclaimer, the term of this patent is extended or adjusted under 35 U.S.C. 154(b) by 470 days.

This patent is subject to a terminal disclaimer.

(21) Appl. No.: 11/049,542

(22) Filed: Feb. 2, 2005

(51) Int. Cl.
*C10G 69/02* (2006.01)
*C10G 51/00* (2006.01)

(52) U.S. Cl. ..... 208/89; 208/58; 208/67; 208/78; 208/95; 208/108; 208/208 R; 208/209; 208/212; 208/213; 208/218

(58) Field of Classification Search ..... 208/58, 208/67, 78, 89, 95, 108, 208 R, 209, 212, 208/213, 218
See application file for complete search history.

(56) References Cited

U.S. PATENT DOCUMENTS

| | | | | |
|---|---|---|---|---|
| 4,943,366 | A | 7/1990 | Fischer et al. | 208/68 |
| 5,904,835 | A * | 5/1999 | Thakkar | 208/78 |
| 6,328,879 | B1 * | 12/2001 | Kalnes | 208/78 |
| 7,097,760 | B1 * | 8/2006 | Kalnes et al. | 208/108 |
| 7,108,779 | B1 * | 9/2006 | Thakkar | 208/89 |

* cited by examiner

*Primary Examiner*—Glenn Caldarola
*Assistant Examiner*—Prem C. Singh
(74) *Attorney, Agent, or Firm*—James C Paschall

(57) ABSTRACT

An integrated process for the hydroprocessing of multiple feedstreams including vacuum gas oil and light cycle oil. The light cycle oil is reacted with hydrogen in a hydrocracking zone and the hydrocarbon feedstream comprising vacuum gas oil is reacted with hydrogen in a hydrodesulfurization reaction zone. The hydrotreated vacuum gas oil is good FCC feedstock. Naphtha and ultra low sulfur diesel are recovered in a common fractionation column.

20 Claims, 1 Drawing Sheet

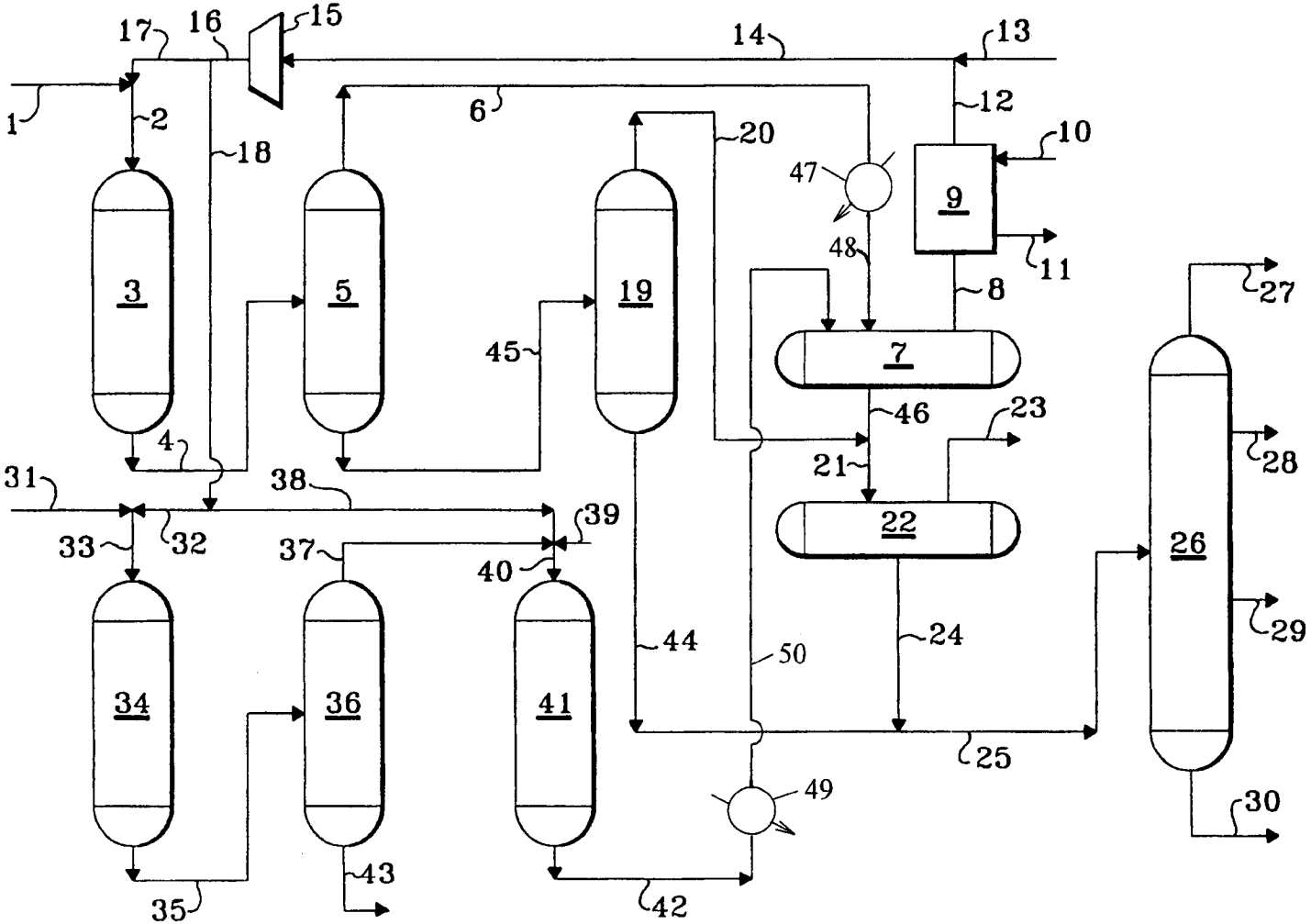
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50

INTEGRATED PROCESS BY HYDROPROCESSING MULTIPLE FEEDS

BACKGROUND OF THE INVENTION

The field of art to which this invention pertains is the hydroprocessing of low value hydrocarbon streams to produce valuable hydrocarbon products. More particularly, the present invention is able to simultaneously desulfurize heavy vacuum gas oil and hydrocrack light cycle oil to produce desulfurized heavy vacuum gas oil, naphtha and ultra low sulfur diesel.

Petroleum refiners often produce desirable products such as turbine fuel, diesel fuel and other products known as middle distillates as well as lower boiling hydrocarbonaceous liquid such as naphtha and gasoline by hydrocracking a hydrocarbon feedstock derived from crude oil, for example. Feedstocks most often subjected to hydrocracking are gas oils and heavy gas oil recovered from crude oil by distillation. A typical gas oil comprises a substantial portion of hydrocarbon components boiling above about 315° C. (600° F.), usually at least about 50 percent by weight boiling above 315° C. (600° F.). A typical vacuum gas oil normally has a boiling point range between about 371° C. (700° F.) and about 565° C. (1050° F.).

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen to yield a product containing a distribution of hydrocarbon products desired by the refiner. The operating conditions and the hydrocracking catalysts within a hydrocracking reactor influence the yield of the hydrocracked products.

Refiners also subject distillate hydrocarbon streams to hydrodesulfurization. Although a wide variety of process flow schemes, operating conditions and catalysts have been used in commercial activities, there is always a demand for new hydroprocessing methods which provide lower costs, more valuable product yields and improved operability.

INFORMATION DISCLOSURE

U.S. Pat. No. 4,943,366 (Fischer et al.) discloses a hydrocracking process for converting highly aromatic, substantially dealkylated feedstock into high octane gasoline.

BRIEF SUMMARY OF THE INVENTION

The present invention is an integrated process for the production of low sulfur diesel and high octane naphtha. The process of the present invention utilizes a light cycle oil feedstream and a hydrocarbon feedstream comprising vacuum gas oil. The light cycle oil is reacted with hydrogen in a hydrocracking zone and the hydrocarbon feedstream comprising vacuum gas oil is reacted with hydrogen in a hydrodesulfurization reaction zone. The resulting effluent from the hydrocracking zone is preferably separated in a hot, vapor liquid separator to produce a vaporous hydrocarbon stream comprising hydrogen and naphtha and liquid hydrocarbon stream having a boiling range greater than the vaporous hydrocarbon stream. The vaporous hydrocarbon stream is partially condensed to provide a hydrogen-rich gaseous stream and a liquid hydrocarbon stream comprising naphtha. The hydrocarbon feedstream comprising vacuum gas oil is reacted with hydrogen in a hydrodesulfurization reaction zone to produce an effluent comprising diesel boiling range hydrocarbons and desulfurized vacuum gas oil which is preferably separated in a hot, vapor liquid separator to provide a vaporous stream comprising diesel boiling range hydrocarbons and a liquid hydrocarbonaceous stream comprising desulfurized vacuum gas oil which is a suitable and preferred feedstock for a fluid catalytic cracking unit. The vaporous stream comprising diesel boiling range hydrocarbons is reacted with hydrogen in a second hydrodesulfurization reaction zone to produce an effluent stream comprising ultra low sulfur diesel boiling range hydrocarbons which is cooled and partially condensed to provide a hydrogen-rich gaseous stream and a liquid hydrocarbonaceous stream comprising ultra low sulfur diesel boiling range hydrocarbons. In a preferred embodiment of the present invention, an additional feedstream comprising diesel boiling range hydrocarbons is also reacted in the second hydrodesulfurization reaction zone to produce additional ultra low sulfur diesel boiling range hydrocarbons. The liquid hydrocarbonaceous stream comprising naphtha and ultra low sulfur diesel boiling range hydrocarbons which is produced during the recovery of the hydrogen-rich gaseous stream is preferably separated in a fractionation zone preferably comprising a flash zone and at least one fractionation zone. The fractionation zone preferably produces a naphtha product stream and an ultra low sulfur diesel product stream. At least a portion of the hydrogen-rich gaseous stream is recycled to the hydrocracking zone and the first hydrodesulfurization reaction zone and preferably to the second hydrodesulfurization reaction zone as well.

The use of a single recycle gas loop to provide hydrogen to the hydrocracking and hydrodesulfurization reaction zones minimizes the vessels required in the integrated process and provides a single process which is capable of successfully handling three separate feedstocks to produce higher value hydrocarbonaceous product streams. The use of the common separation and fractionation zones result in the advantages of lower capital and operating expenses.

Other embodiments of the present invention encompass further details such as detailed description of feedstocks, hydrodesulfurization catalysts, hydrocracking catalysts and preferred operating conditions, all of which are hereinafter disclosed in the following discussion of each of these facets of the invention.

BRIEF DESCRIPTION OF THE DRAWING

The drawing is a simplified process flow diagram of a preferred embodiment of the present invention. The above described drawing is intended to be schematically illustrative of the present invention and is not to be a limitation thereof.

DETAILED DESCRIPTION OF THE INVENTION

The present invention is an integrated process for the hydrocracking of light cycle oil and the hydrodesulfurization of a feedstream comprising vacuum gas oil. Preferred feedstocks for the hydrodesulfurization reaction zone include distillate hydrocarbons boiling at a temperature greater than about 315° C. (600° F.) with at least a majority boiling in the range from about 371° C. (700° F.) to about 565° C. (1050° F.).

The preferred light cycle oil feedstocks boil in the range from about 149° C. (300° F.) to about 343° C. (650° F.). Light cycle oil (LCO) is a highly aromatic, substantially dealkylated hydrocarbon produced during the fluid catalytic cracking (FCC) of vacuum gas oils to produce high octane gasoline boiling range hydrocarbons. Recycling LCO to catalytic cracker is not an attractive option. A typical LCO contains about 3 weight percent sulfur, about 700 wppm nitrogen and greater than about 80 volume percent aromatics. Present market requirements make refractory product streams such as LCO particularly difficult to dispose of as commercially valuable products.

In accordance with the present invention, a light cycle oil feedstock is introduced into a hydrocracking zone and the hydrocracking zone may contain one or more beds of the same or different catalyst. In one embodiment the preferred hydrocracking catalysts utilize amorphous bases or low-level zeolite bases combined with one or more Group VIII or Group VIB metal hydrogenating components. In another embodiment the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a silica/alumina mole ratio between about 3 and 12. Suitable zeolites found in nature include, for example, mordenite, stillbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with ammonium salt, then partially back exchanging with a polyvalent metal salt and then calcining. In some case, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of e.g., 371°-648° C. (700°-1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalyst, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the light cycle oil feedstock in contact with a hydrocracking catalyst is conducted in the presence of hydrogen and preferably at hydrocracking reactor conditions which include a temperature from about 260° C. (500° F.) to about 426° C. (800° F.), a pressure from about 7.0 MPa (1000 psig) to about 10.5 MPa (1500 psig), a liquid hourly space velocity (LHSV) from about 0.1 to about 30 $hr^{-1}$, and a hydrogen circulation rate from about 2000 (337 normal $m^3/m^3$) to about 25,000 (4200 normal $m^3/m^3$) standard cubic feet per barrel.

The resulting effluent from the hydrocracking zone is preferably introduced into a hot, vapor liquid separator preferably operated at a temperature from about 232° C. (450° F.) to about 371° C. (700° F.) and a pressure from about 7.0 MPa (1000 psig) to about 10.5 MPa (1500 psig) to provide a vaporous hydrocarbon stream comprising hydrogen and naphtha, and a liquid hydrocarbon stream having a boiling range greater than the vaporous hydrocarbon stream. The vaporous hydrocarbonaceous stream is cooled to a temperature preferably in the range from about 15° C. (60° F.) to about 60° C. (140° F.), partially condensed and introduced into a cold vapor liquid separator to provide a hydrogen-rich gaseous stream and a liquid hydrocarbon stream comprising naphtha. The resulting liquid hydrocarbon stream comprising naphtha is preferably introduced into a cold flash zone to recover a vapor stream comprising normally gaseous hydrocarbons and dissolved hydrogen. A resulting liquid hydrocarbon stream is transferred from the cold flash zone and introduced into a fractionation zone to recover a high octane naphtha stream. The liquid hydrocarbon stream having a boiling range greater than the vaporous hydrocarbon stream resulting from the hot, vapor liquid separator is introduced into a hot flash zone to produce a vaporous stream which is cooled, partially condensed and introduced into a cold flash zone and a liquid hydrocarbonaceous stream which is introduced into a fractionation zone.

In accordance with the present invention, a distillate hydrocarbon stream comprising vacuum gas oil and preferably boiling at a temperature greater than about 315° C. (600° F.)

is introduced into a hydrodesulfurization reaction zone together with a hydrogen-rich gaseous stream at hydrodesulfurization reaction conditions. Preferred hydrodesulfurization reaction conditions include a temperature from about 260° C. (500° F.) to about 426° C. (800° F.), a pressure from about 7.0 MPa (1000 psig) to about 10.5 MPa (1500 psig), and a liquid hourly space velocity from about $0.1^{-1}$ hr to about 10 $hr^{-1}$.

Suitable hydrodesulfurization catalysts for use in the present invention are any known convention hydrodesulfurization catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrodesulfurization catalysts include zeolitic catalysts, as well as noble metal catalysts where the noble metal is selected from palladium and platinum. It is within the scope of the present invention that more than one type of hydrodesulfurization catalyst be used in the same reaction vessel. Two or more catalyst beds and one or more quench points may be utilized in the reaction vessel or vessels. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

The resulting effluent comprising diesel boiling range hydrocarbons and desulfurized vacuum gas oil from the hydrodesulfurization reaction zone is preferably separated in a hot, vapor liquid separator operated at a temperate from about 204° C. (400° F.) to about 371° C. (700° F.) and a pressure from about 7.0 MPa (1000 psig) to about 10.5 MPa (1500 psig) to provide a vaporous hydrocarbon stream comprising hydrogen and diesel boiling range hydrocarbons, and a liquid hydrocarbon stream comprising desulfurized vacuum gas oil which is a suitable and preferred feedstock for a fluid catalytic cracking unit. The vaporous hydrocarbon stream comprising hydrogen and diesel boiling range hydrocarbons is preferably reacted in a second hydrodesulfurization reaction zone to produce an effluent stream comprising hydrogen and ultra low sulfur diesel boiling range hydrocarbons which is cooled, partially condensed and introduced into a cold vapor liquid separator to provide a hydrogen-rich gaseous stream and a liquid hydrocarbonaceous stream comprising ultra low sulfur diesel boiling range hydrocarbons. The resulting liquid hydrocarbonaceous stream comprising ultra low sulfur diesel boiling range hydrocarbons is introduced into a cold flash zone to recover a vapor stream comprising normally gaseous hydrocarbons and dissolved hydrogen. A resulting liquid hydrocarbon steam is transferred from the cold flash zone and introduced into a fractionation zone to recover an ultra low sulfur diesel stream. The hydrogen-rich gaseous stream is preferably scrubbed with an aqueous amine solution to remove at least a portion of the hydrogen sulfide contained therein. An additional feedstream, in a preferred embodiment, comprising diesel boiling range hydrocarbons is also reacted in the second hydrodesulfurization reaction zone to produce additional ultra low sulfur diesel boiling range hydrocarbons. The second hydrodesulfurization reaction zone is preferably operated in the range of conditions previously taught for the first hydrodesulfurization reaction zone and with any of the previously described hydrodesulfurization catalysts but not necessarily the same catalyst or operating conditions.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

Referring now to the drawing, a hydrocarbon stream containing light cycle oil is introduced into the process via line 1 and is admixed with a hydrogen-rich recycle gas provided via line 17 and the resulting admixture is carried via line 2 and introduced into hydrocracking reaction zone 3. A resulting hydrocracked hydrocarbonaceous stream is removed from hydrocracking reaction zone 3 via line 4 and introduced into hot, high pressure separator 5. A vaporous stream containing hydrogen and naphtha boiling range hydrocarbons is removed from hot, high pressure separator 5 via line 6, cooled in heat exchanger 47, partially condensed and introduced into cold vapor liquid separator 7 via line 48. A hydrogen-rich gaseous stream containing hydrogen sulfide is removed from cold vapor liquid separator 7 via line 8 and introduced into absorption zone 9. A lean aqueous amine scrubbing solution is introduced into absorption zone 9 via line 10 and is used to scrub the hydrogen-rich gaseous stream containing hydrogen sulfide in order to remove at least a portion of the hydrogen sulfide therefrom. A rich aqueous amine scrubbing solution containing hydrogen sulfide is removed from absorption zone 9 via line 11 and recovered. A hydrogen-rich gaseous stream having a reduced concentration of hydrogen sulfide is removed from absorption zone 9 via line 12 and is admixed with a makeup hydrogen stream provided via line 13 and the resulting admixture is carried via line 14 and introduced into compressor 15. A compressed hydrogen-rich gaseous stream is removed from compressor 15 via line 16 and a first portion is carried via line 17 and introduced via line 2 into hydrocracking reaction zone 3 as described hereinabove. A second portion of the compressed hydrogen-rich gaseous stream is carried via line 18 to supply hydrodesulfurization reaction zone 34 and hydrodesulfurization reaction zone 41 as described hereinafter. A liquid hydrocarbonaceous stream containing diesel boiling range hydrocarbons is removed from hot, high pressure separator 5 via line 45 and introduced into hot flash zone 19. A vaporous hydrocarbonaceous stream is removed from hot flash zone 19 via line 20, cooled, partially condensed and introduced via lines 20 and 21 into cold flash zone 22. A liquid hydrocarbonaceous stream is removed from hot flash zone 19 via line 44 and introduced into fractionation zone 26 via lines 44 and 25. A heavy hydrocarbonaceous stream containing vacuum gas oil is introduced into the process via line 31 and is admixed with a hydrogen-rich recycle gas provided via line 32 and the resulting admixture is carried via line 33 and introduced into hydrodesulfurization reaction zone 34. A desulfurized hydrocarbonaceous stream is removed from hydrodesulfurization reaction zone 34 via line 35 and introduced into hot, high pressure separator 36. A liquid hydrocarbonaceous stream containing desulfurized vacuum gas oil is removed from hot, high pressure separator 36 via line 43 and recovered. A vaporous hydrocarbon stream containing diesel boiling range hydrocarbons is removed from hot, high pressure separator 36 via line 37 and is admixed with a hydrogen-rich gaseous stream provided via line 38 and a diesel boiling range hydrocarbonaceous feed stream provided via line 39 and the resulting admixture is carried via line 40 and introduced into hydrodesulfurization reaction zone 41. A desulfurized hydrocarbonaceous stream containing diesel boiling range hydrocarbons is removed from hydrodesulfurization reaction zone 41 via line 42, cooled in heat exchanger 49, partially condensed, and introduced into cold vapor liquid separator 7 via line 50. A liquid hydrocarbonaceous stream containing naphtha boiling range compounds and diesel boiling range compounds is removed from cold vapor liquid separator 7 via line 46 and introduced into cold flash zone 22 via lines 46 and 21. Light normally gaseous hydrocarbons are removed from cold flash zone 22 via line 23 and recovered. A liquid hydrocarbonaceous stream containing normally gaseous hydrocarbons, naphtha and diesel boiling range hydrocarbons is removed from cold flash zone 22 via line 24 and introduced into fractionation zone 26 via lines 24 and 25. A hydrocarbon stream containing normally gaseous hydrocarbons is removed from fractionation zone 26 via line 27 and recovered. A hydrocarbonaceous stream containing lower boiling naphtha hydrocarbons is removed from fractionation zone 26 via line 28 and recovered. A hydrocarbon stream containing higher boiling naphtha hydrocarbons is removed from fractionation zone 26 via line 29 and recovered. A hydrocarbon stream containing ultra low sulfur diesel is removed from fractionation zone 26 via line 30 and recovered.

The process of the present invention is further demonstrated by the following illustrative embodiment. This illustrative embodiment is, however, not presented to unduly limit the process of this invention, but to further illustrate the advantage of the hereinabove-described embodiment. The following data were not obtained by the actual performance of the present invention but are considered prospective and reasonably illustrative of the expected performance of the invention.

ILLUSTRATIVE EMBODIMENT

A light cycle oil stream in an amount of 4,000 $m^3$/day and having the characteristics presented in Table 1 is introduced into hydrocracking zone containing hydrocracking catalyst and operated at a pressure of about 10.4 MPa (1500 psig) and a temperature sufficient to convert about 60 weight percent of the light cycle oil to high octane naphtha.

A feed stream in an amount of 8,800 $m^3$/day and comprising vacuum gas oil and having the characteristics presented in Table 2 is introduced into a first hydrodesulfurization reaction zone containing hydrodesulfurization catalyst and operated at a pressure of about 10.4 MPa (1500 psig) and a temperature sufficient to achieve a significant reduction in the hydrocarbon sulfur content. In addition, about 250 $m^3$/day of diesel boiling range hydrocarbons produced during this primarily desulfurization reaction are introduced into a second hydrodesulfurization reaction zone to further reduce the sulfur concentration to produce diesel boiling range hydrocarbons having an ultra low sulfur level. The second hydrodesulfurization reaction zone is operated at a pressure of about 10.4 MPa (1500 psig) and a temperature to achieve the desired level of desulfurization. In addition, a diesel boiling range hydrocarbon stream in an amount of 2,100 $m^3$/day and having the characteristics in Table 3 is also introduced into the second hydrodesulfurization reaction zone.

The effluent products from the hydrocracking reaction zone and both of the hydrodesulfurization reaction zones is recovered and fractionated to produce 2,700 $m^3$/day of naphtha, 4,200 $m^3$/day of ultra low sulfur diesel and 8,300 $m^3$/day of desulfurized high boiling hydrocarbons suitable for feed to a fluid catalytic cracking (FCC) process. The resulting product naphtha is sulfur free and has an octane rating of 90. The resulting ultra low sulfur diesel product contains less than 10 wppm sulfur and a cetane index of 45. The resulting FCC feed contains 1500 wppm sulfur.

TABLE 1

| Light Cycle Oil Analysis | | |
|---|---|---|
| Specific Gravity | | 0.950 |
| Sulfur, weight percent | | 2 |
| Nitrogen, wppm | | 900 |
| | Distillation, ° C. (° F.) | |
| IBP | 191 | (375) |
| 10 | 257 | (495) |
| 50 | 296 | (565) |
| 90 | 343 | (650) |
| EP | 371 | (700) |

TABLE 2

| Vacuum Gas Oil Analysis | | |
|---|---|---|
| Specific Gravity | | 0.98 |
| Sulfur, weight percent | | 3.3 |
| Nitrogen, wppm | | 3200 |
| | Distillation, ° C. (° F.) | |
| IBP | 288 | (550) |
| 10 | 393 | (740) |
| 50 | 471 | (880) |
| 90 | 538 | (1000) |
| EP | 565 | (1050) |

TABLE 3

| Coker Diesel Analysis | | |
|---|---|---|
| Specific Gravity | | 0.9 |
| Sulfur, weight percent | | 3.1 |
| Nitrogen, wppm | | 600 |
| | Distillation, ° C. (° F.) | |
| IBP | 215 | (420) |
| 10 | 260 | (500) |
| 50 | 293 | (560) |
| 90 | 343 | (650) |
| EP | 376 | (710) |

The foregoing description, drawing and illustrative embodiment clearly illustrate the advantages encompassed by the process of the present invention and the benefits to be afforded with the use thereof.

What is claimed is:

1. An integrated process for hydroprocessing multiple feed streams which process comprises the following steps:

(a) reacting a light cycle oil feedstream in a hydrocracking reaction zone containing hydrocracking catalyst to produce lower boiling hydrocarbons comprising naphtha;

(b) separating the lower boiling hydrocarbons comprising naphtha in a first separation zone to produce a vaporous hydrocarbon stream comprising hydrogen and naphtha, and a first liquid hydrocarbon stream;

(c) partially condensing the vaporous hydrocarbon stream comprising hydrogen and naphtha from step (b) to produce a hydrogen-rich gaseous stream and at least a portion of a second liquid hydrocarbon stream;

(d) reacting a separate hydrocarbon feedstream comprising vacuum gas oil in a hydrodesulfurization reaction zone to produce a desulfurized hydrocarbon stream comprising diesel boiling range hydrocarbons and desulfurized vacuum gas oil;

(e) separating the desulfurized hydrocarbon stream comprising diesel boiling range hydrocarbons and desulfurized vacuum gas oil from step (d) in a second separation zone to produce a vaporous hydrocarbon stream comprising hydrogen and diesel boiling range hydrocarbons, and a third liquid hydrocarbonaceous stream containing desulfurized vacuum gas oil;

(f) recycling at least a portion of the hydrogen-rich gaseous streams produced in steps (c) and (e) to the hydrocracking zone and the hydrodesulfurization reaction zone; and (g) recovering desulfurized diesel boiling range hydrocarbons.

2. The process of claim 1 wherein the second liquid hydrocarbonaceous stream comprises naphtha and desulfurized diesel boiling range hydrocarbons.

3. The process of claim 1 wherein at least a portion of the liquid hydrocarbonaceous stream containing desulfurized vacuum gas oil is reacted in a fluid catalytic cracking process.

4. The process of claim 1 wherein the light cycle feedstream boils in the range from about 149° C. (300° F.) to about 343° C. (650° F.).

5. The process of claim 1 wherein the hydrocarbon feedstock comprising gas oil boils at a temperature greater than about 315° C. (600° F.).

6. The process of claim 1 wherein the first and second separation zones are hot, vapor liquid separators.

7. An integrated process for hydroprocessing multiple feed streams which process comprises the following steps:

(a) reacting a light cycle oil feedstream in a hydrocracking reaction zone containing hydrocracking catalyst to produce lower boiling hydrocarbons comprising naphtha;

(b) separating the lower boiling hydrocarbons comprising naphtha in a first hot vapor liquid separator to produce a vaporous hydrocarbon stream comprising hydrogen and naphtha, and a first liquid hydrocarbon stream;

(c) partially condensing the vaporous hydrocarbon stream comprising hydrogen and naphtha from step (b) to produce a hydrogen-rich gaseous stream and at least a portion of a second liquid hydrocarbon stream;

(d) reacting a separate hydrocarbon feedstream comprising vacuum gas oil in a first hydrodesulfurization reaction zone to produce a desulfurized hydrocarbon stream comprising diesel boiling range hydrocarbons and desulfurized vacuum gas oil;

(e) separating the desulfurized hydrocarbon stream comprising diesel boiling range hydrocarbons and desulfurized vacuum gas oil from step (d) in a second hot vapor liquid separator to produce a vaporous hydrocarbon stream comprising hydrogen and diesel boiling range hydrocarbons, and a third liquid hydrocarbonaceous stream containing desulfurized vacuum gas oil;

(f) reacting the vaporous hydrocarbon stream comprising hydrogen and diesel boiling range hydrocarbons from step (e) in a second hydrodesulfurization reaction zone to produce a second hydrodesulfurization reaction zone effluent;

(g) partially condensing the second hydrodesulfurization reaction zone effluent to produce a hydrogen-rich gaseous stream and at least a portion of the second liquid hydrocarbonaceous stream;

(h) recycling at least a portion of the hydrogen-rich gaseous streams produced in steps (c) and (g) to the hydrocracking reaction zone and the first hydrodesulfurization reaction zone; and (i) recovering desulfurized diesel boiling range hydrocarbons.

8. The process of claim 7 wherein a diesel boiling range hydrocarbon feedstock is desulfurized in the second hydrodesulfurization reaction zone.

9. The process of claim 7 wherein the second liquid hydrocarbonaceous stream comprises naphtha and desulfurized diesel boiling range hydrocarbons.

10. The process of claim 7 wherein at least a portion of the third liquid hydrocarbonaceous stream containing desulfurized vacuum gas oil is reacted in a fluid catalytic cracking process.

11. The process of claim 7 wherein the light cycle feedstream boils in the range from about 149° C. (300° F.) to about 343° C. (650° F.).

12. The process of claim 7 wherein the hydrocarbon feedstock comprising gas oil boils at a temperature greater than about 315° C. (600° F.).

13. The process of claim 7 wherein the first hot, vapor liquid separator is operated at conditions including a temperature from about 232° C. (450° F.) to about 371° C. (700° F.) and a pressure from about 7.0 MPa (1000 psig) to about 10.5 MPa (1500 psig).

14. The process of claim 7 wherein the second hot, vapor liquid separator is operated at conditions including a temperature from about 204° C. (400° F.) to about 371° C. (700° F.) and a pressure from about 7.0 MPa (1000 psig) to about 10.5 MPa (1500 psig).

15. The process of claim 7 wherein a diesel boiling range hydrocarbon feedstock is reacted in the second hydrodesulfurization reaction zone.

16. An integrated process for hydroprocessing multiple feedstreams which process comprises the following steps:

(a) reacting a light cycle oil feedstream boiling in the range from about 149° C. (300° F.) to about 343° C. (650° F.) in a hydrocracking reaction zone containing hydrocracking catalyst to produce lower boiling hydrocarbons comprising naphtha;

(b) separating the lower boiling hydrocarbons comprising naphtha in a first hot, vapor liquid separator operated at a temperature from about 450° F. (232° C.) to about 700° F. (371° C.) and a pressure from about 7.0 MPa (1000 psig) to about 10.5 MPa (1500 psig) to produce a vaporous hydrocarbon stream comprising hydrogen and naphtha, and a first liquid hydrocarbon stream;

(c) partially condensing the vaporous hydrocarbon stream comprising hydrogen and naphtha from step (b) to produce a hydrogen-rich gaseous stream and at least a portion of a second liquid hydrocarbon stream;

(d) reacting a separate hydrocarbon feedstream comprising vacuum gas oil in a first hydrodesulfurization reaction zone to produce a desulfurized hydrocarbon stream comprising diesel boiling range hydrocarbons and desulfurized vacuum gas oil;

(e) separating the desulfurized hydrocarbon stream comprising diesel boiling range hydrocarbons and desulfurized vacuum gas oil from step (d) in a second hot, vapor liquid separator operated at a temperature from about 204° C. (400° F.) to about 371° C. (700° F.) and a pressure from about 7.0 MPa (1000 psig) to about 10.5 MPa (1500 psig) to produce a vaporous hydrocarbon stream comprising hydrogen and diesel boiling range hydrocarbons, and a third liquid hydrocarbonaceous stream containing desulfurized vacuum gas oil;

(f) reacting the vaporous hydrocarbon stream comprising hydrogen and diesel boiling range hydrocarbons from step (e) and a diesel boiling range hydrocarbon feedstock in a second hydrodesulfurization reaction zone to produce a second hydrodesulfurization reaction zone effluent;

(g) partially condensing the second hydrodesulfurization reaction zone effluent to produce a hydrogen-rich gaseous stream and at least a portion of the second liquid hydrocarbonaceous stream;

(h) recycling at least a portion of the hydrogen-rich gaseous streams produced in steps (c) and (g) to the hydrocracking reaction zone and the first hydrodesulfurization reaction zone; and (i) recovering desulfurized diesel boiling range hydrocarbons.

17. The process of claim 16 wherein the second liquid hydrocarbonaceous stream comprises naphtha and desulfurized diesel boiling range hydrocarbons.

18. The process of claim 16 wherein at least a portion of the desulfurized vacuum gas oil is reacted in a fluid catalytic cracking process.

19. The process of claim 16 wherein the light cycle feedstream boils in the range from about 149° C. (300° F.) to about 343° C. (650° F.).

20. The process of claim 16 wherein the hydrocarbon feedstock comprising gas oil boils at a temperature greater than about 315° C. (600° F.).

* * * * *